US012064013B2

(12) United States Patent
Coleman

(10) Patent No.: US 12,064,013 B2
(45) Date of Patent: Aug. 20, 2024

(54) SUPPORTIVE FOOTWEAR FOR ATHLETIC TRAINING

(71) Applicant: Byron Coleman, Lake Havasu, AZ (US)

(72) Inventor: Byron Coleman, Lake Havasu, AZ (US)

( * ) Notice: Subject to any disclaimer, the term of this patent is extended or adjusted under 35 U.S.C. 154(b) by 0 days.

(21) Appl. No.: 17/871,914

(22) Filed: Jul. 23, 2022

(65) Prior Publication Data

US 2022/0354209 A1 Nov. 10, 2022

Related U.S. Application Data

(63) Continuation of application No. 15/288,091, filed on Oct. 7, 2016, now abandoned.

(51) Int. Cl.

| | |
|---|---|
| ***A43B 5/12*** | (2006.01) |
| ***A43B 3/12*** | (2006.01) |
| ***A43B 5/08*** | (2006.01) |
| ***A43B 7/20*** | (2006.01) |
| *A43B 23/02* | (2006.01) |

(52) U.S. Cl.

CPC ..... *A43B 5/12* (2013.01); *A43B 3/126* (2013.01); *A43B 5/08* (2013.01); *A43B 7/20* (2013.01); *A43B 3/128* (2013.01); *A43B 23/0245* (2013.01)

(58) Field of Classification Search

CPC ..... A43B 5/12; A43B 3/12; A43B 3/105; A43B 3/126; A43B 7/26; A41B 11/004

See application file for complete search history.

(56) References Cited

U.S. PATENT DOCUMENTS

| | | | | |
|---|---|---|---|---|
| 2,708,930 | A * | 5/1955 | Lowman | A61F 13/065 602/66 |
| 3,656,244 | A * | 4/1972 | Andrade | A43B 3/0078 D2/896 |
| 5,205,071 | A * | 4/1993 | Hergenroeder | A43B 5/08 36/8.1 |
| 5,257,969 | A * | 11/1993 | Mance | A61F 5/0113 602/30 |
| 5,386,710 | A * | 2/1995 | Moore | A44C 15/009 63/3 |
| 6,367,087 | B1 * | 4/2002 | Spillman | A41B 11/004 2/239 |
| 6,629,943 | B1 * | 10/2003 | Schroder | A61F 5/019 602/30 |
| 6,800,063 | B2 * | 10/2004 | Iwata | A61H 7/001 600/15 |
| 7,739,810 | B2 * | 6/2010 | Luedecke | A43B 7/18 36/114 |
| D653,984 | S * | 2/2012 | Carroll | D2/896 |
| D717,961 | S * | 11/2014 | Rupert | D24/192 |

(Continued)

*Primary Examiner* — Megan E Lynch

(74) *Attorney, Agent, or Firm* — Barry Choobin; Patent 360

(57) ABSTRACT

A shoe has a main body, an ankle strap, plantar bridge, and a toe loop connected to the main body. The main body wraps around the dorsal instep area of the foot and the plantar bridge wraps around the plantar midfoot area of the foot, without covering the ball, the plantar metatarsals, the heel, or the toes. The ankle strap is attached at its ends to the main body and extends around the back of the foot above the heel for constraining the main body from forwarding movement. The toe loop surrounds one of the toes and connects with the main body from above the foot, for constraining the main body from rearward movement.

4 Claims, 11 Drawing Sheets

(56) References Cited

U.S. PATENT DOCUMENTS

2004/0078997 A1* 4/2004 Pledger ..... A43B 23/24 36/1
2006/0137224 A1* 6/2006 Song ..... A63B 71/1225 36/72 R
2006/0161090 A1* 7/2006 Lee ..... A61F 13/066 602/61
2006/0288609 A1* 12/2006 Wilkenfeld ..... A43B 13/16 36/8.3
2007/0006486 A1* 1/2007 Wilkenfeld ..... A43B 3/00 36/8.3
2007/0113387 A1* 5/2007 Gerhardt ..... A43B 3/126 24/712
2007/0130796 A1* 6/2007 Iwata ..... A61H 11/00 36/94
2008/0110045 A1* 5/2008 Terlizzi ..... A43B 7/144 36/8.3
2009/0100715 A1* 4/2009 Broadley ..... A43B 5/12 36/102
2009/0265954 A1* 10/2009 Goldberg ..... A43B 23/24 36/11.5
2011/0016745 A1* 1/2011 Hammerbeck ..... A43B 3/248 36/11.5
2012/0167278 A1* 7/2012 House ..... A61F 5/01 2/244
2012/0232453 A1* 9/2012 Cropper ..... A61F 5/3715 602/30
2013/0066249 A1* 3/2013 Eldridge ..... A61F 5/0111 602/28
2013/0091732 A1* 4/2013 Mendoza ..... A43B 3/0078 36/100
2014/0223770 A1* 8/2014 Fallow ..... A43B 5/12 36/83
2014/0350447 A1* 11/2014 Brass ..... A61F 5/019 602/30
2015/0020415 A1* 1/2015 Teitz ..... A43B 3/126 36/100
2016/0302953 A1* 10/2016 Amanatullah ..... A61F 5/0111
2017/0086516 A1* 3/2017 Parenteau ..... A41D 13/087

* cited by examiner

SUPPORTIVE FOOTWEAR FOR ATHLETIC TRAINING

CROSS-REFERENCE TO RELATED APPLICATIONS

This application is a continuation of a U.S. patent application Ser. No. 15/288,091 filed on Oct. 7, 2016, which is incorporated herein by reference in its entirety.

FIELD OF INVENTION

The present invention relates to supportive footwear, and more particularly to supportive footwear that protects feet during athletic exercises including yoga, and allows for optimum balance, movement, and proprioception (sensory input).

BACKGROUND

Protective gears are extensively used in athletic training to prevent injuries and provide support to body movements. Certain athletic training, such as Yoga requires complex body bending movements. In yoga training, the feet are particularly susceptible to injury due to extensive and repeated bending of the feet. Trainees generally wear tight socks for support; however, the socks provide general support to the feet but do not counter the force during bending of the feet. Moreover, the socks form a barrier between the sensory receptors of the feet and the contact surface or mat.

For example, Lindsay, U.S. 2004/0261289, teaches a yoga sandal with a sole portion, an elastic foot covering portion, and a rear strap portion. The sole portion is flexible, thin, and has a non-slip surface that contacts the floor. The sole portion covers both the arch and the ball area of the user's foot, but not the toe and heel areas. The elastic foot covering portion is attached to the sole portion at each side edge of the sole so that the foot covering portion fits snuggly on the top central portion of the user's foot. The strap portion is attached to the rear edge of each side of the elastic foot covering so that the strap can retain the user's foot within the sandal. While this reference teaches a sandal that covers the arch and leaves the heel exposed, it also covers the ball of the foot and does not engage the user's toe(s).

Song, U.S. Pat. No. 7,682,326, teaches a foot protection device adapted to protect a user's feet when training and playing fighting games. The device includes an upper and an exterior cover for covering the bottom of the foot. The exterior cover covers most of the bottom of the foot but includes an anterior hole over the ball of the foot, and a posterior hole over the heel. The toes are mostly covered, and toe holes are provided so that the ends of the toes extend out of the device and are not covered. While this reference teaches holes for the heel and ball of the foot, the toe portion covers the toes and is connected with the arch cover, except for the hole. A similar device is also shown in Luedecke, U.S. Pat. No. 7,739,810.

Logan, U.S. Pat. No. 8,240,066, teaches an arch support device that elevates the midsection of the foot. The device does not cover the metatarsus or heel and is attached to the foot by lateral straps or equivalents. The device does not engage the toes.

Hergenroeder, U.S. Pat. No. 5,205,071, teaches a surfing sandal that includes an instep pad adapted to extend across the instep at the top of the foot and a traction surface adapted to extend across the bottom of the foot between the heel and the ball of the foot. An ankle strap holds the pad and sole rearward while a toe strap holds the pad and sole forward. Importantly, the device is attached to the big toe with a connector; however, the connector extends across the ball of the foot, beneath the foot, rather than from the top of the foot connected to the upper.

Heathcote et al., U.S. 2014/0033567, teaches dance footwear that includes a fabric tube formed of a continuous elastic material to receive and partially cover the foot, the tube comprising a heel end and an opposite toe end having at least two toe openings to receive toes; and one floor-engaging forefoot pad disposed on the tube near the toe end to underlying a ball of the foot; wherein the tube defines first and second openings at the heel end and a heel strap to extend around the Achilles tendon of the heel between the first and second openings and thereby retain the footwear on the foot.

Broadley, U.S. 2009/0100715, teaches a shoe that provides a sole under the ball of the foot but none below the arch or heel. An upper encircles the metatarsal bones and the distal end of the tarsals. An inelastic ankle band shaped as "C" holds the shoe on the foot. Support is mainly longitudinal, includes over the arch, may be adjustable, and is provided without causing foot distortion Thus, a need is appreciated for novel and specialized footwear for athletic training and exercises such as yoga.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

In one aspect, disclosed is novel specialized footwear to be used during the practice of yoga that provides the user all the natural sensory perception and grip along the plantar contact surface of the user's foot and toes. This uniquely designed footwear functions like a second skin on the foot to allow the user to perform a wide range of movements while the shoe stays snugly in place on the user's foot during the challenging movements associated with physically demanding activities such as yoga. The footwear can support the feet during flexing and bending for correct orientation and prevention of injury. All the plantar surface is exposed and uncovered except for a small portion at the base of a toe where the toe loop is secured as well as a small portion of the bridge of the main body of the shoe that covers the area directly under the tarsal bones at the midfoot area of the foot leaving the balance of the plantar surface exposed.

The present invention provides a shoe having a main body, a plantar bridge of a main body, an ankle strap, and a toe loop. The tubular main body having a broader V-shaped upper portion adapted to wrap around the instep of the foot and a narrow portion of the main body that covers a limited portion of the plantar surface is called the plantar bridge of the main body. This plantar bridge is adapted to cover a limited portion of the plantar surface directly under the midfoot, without covering the ball of the foot, the metatarsals, the heel, or the toes. The ankle strap is attached at its ends to the main body and extends around the back of the foot above the heel for constraining the main body from forward movement. The toe loop surrounds one of the toes; The toe loop connects with the main body from above the foot to constrain the main body from rearward movement. The toe loop adapted to encircle a toe around a base of the encircled toe, leaving the pad of encircled toe exposed without covering any of the other toes. The toe loop connects with the main body from above the foot for constraining the main body from rearward movement, without covering the ball of the foot or the toes.

In one embodiment, the shoe has four primary areas of contact on the user's foot that allows the shoe to stay in place, 1. at the base of a toe or toes where the toe loop wraps around a base of a toe or toes; 2. at the dorsal instep area where the V-shaped main body wraps around the dorsal instep area, 3. at the plantar midfoot area directly under the five tarsal bones where the plantar bridge wraps under the tarsal bones, and 4. at the back of the foot above the heel where the ankle strap wraps around the back of the heel area. This makes the shoe desirable to perform a variety of activities such as yoga, Pilates, dance, gymnastics, surfing, and other activities in which the user can benefit because the footwear allows the user to experience a nearly barefoot sensory perception and natural grip as the shoe stays in close, snug contact to protect and support the foot during these types of physically demanding activities. The toe loop, tubular V-shaped main body, plantar bridge, and ankle strap are purposely designed to work in unison to achieve the benefits and overall functionality of this performance footwear. A primary objective of the present invention is to provide a shoe that has advantages not taught by the prior art.

Another objective is to provide a shoe that contacts the foot in four locations, the toe, the instep/metatarsal area, the plantar midfoot, and the heel.

Another objective is to provide a shoe that contacts the dorsal instep or metatarsal area of the foot and the plantar midfoot area directly under the tarsal bones of the foot, without covering the toes, the ball area, or the heel area of the foot.

A further objective is to provide a shoe adapted with a plantar bridge, the plantar bridge of the main body is a smaller portion of the tubular main body that connects with the larger V-shaped main body with the narrow bridge portion of the main body that is configured in a single piece member that traverses from side to side across a plantar surface of the midfoot area directly under the five tarsal bones of the foot. The plantar bridge is adapted with a forward edge 26 and a rearward edge 28 with solid coverage between the two edges on the area directly under the tarsal bones as shown in FIG. 3

Another objective is to provide a shoe that contacts the dorsal instep or metatarsal area of the foot and the plantar midfoot area of the foot, without covering toes, the ball area of the foot, or the heel area of the foot.

A further objective is to provide a shoe that is lightweight, comfortable, and in close, snug contact with the foot to not interfere with the physical activities of the user.

In one aspect, disclosed is a shoe that has a tubular V-shaped main body that wraps around the foot with the dorsal aspect of the shoe covering a majority of the dorsal instep surface area in a solid V-shaped coverage, and the plantar aspect of the shoe called the plantar bridge covering a limited portion of the plantar surface directly under the tarsal bones of the foot from side to side.

In one aspect, disclosed is a specialized type of protective and supportive footwear to be worn in a variety of physical activities associated with yoga, Pilates, gymnastics and dance as well as other similar physically demanding activities. The novel design of this footwear allows the user to experience a nearly barefoot sensory perception and a natural grip on the plantar surface of the foot as it stays in close snug contact to protect and support the foot while not interfering with the foot during the challenging movements associated with these types of physically demanding activities.

All the components and physical design features of this new footwear work in unison to provide a lightweight, comfortable, and protective type of specialized footwear. The toe loop, tubular main body, ankle strap, and plantar bridge are purposely designed to work together in unison to achieve the benefits and overall functionality of this performance footwear.

Other features and advantages of the present invention will become apparent from the following, more detailed description, taken in conjunction with the accompanying drawings, which illustrate, by way of example, the principles of the invention.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
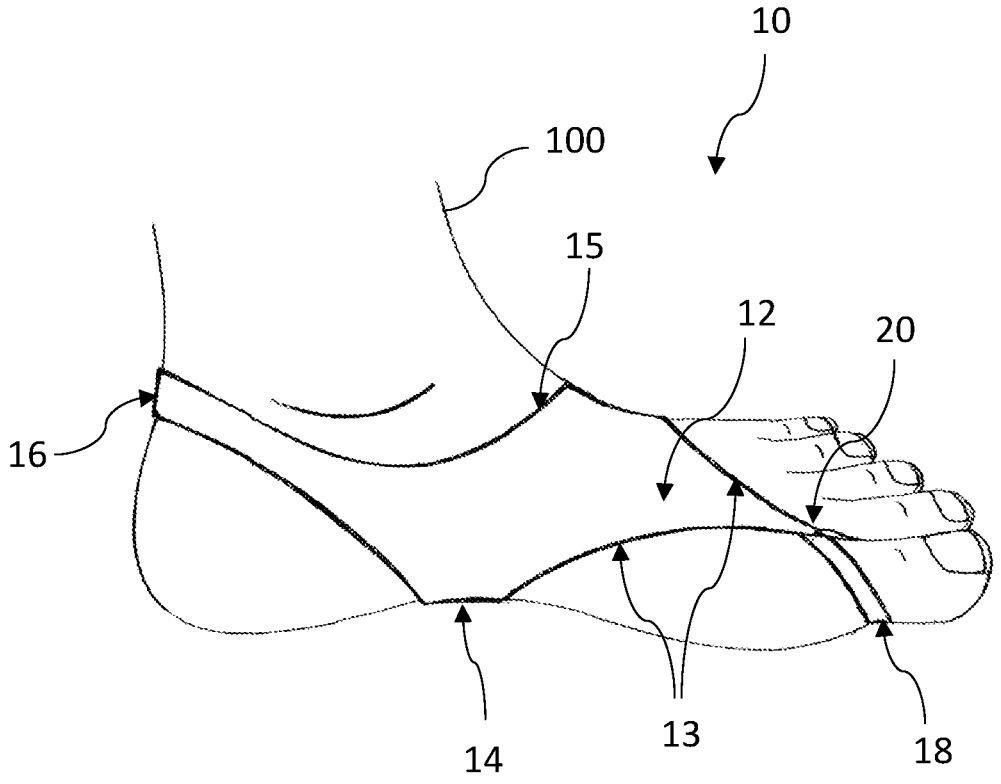
FIG. 1 is a medial view of a left foot of a user wearing the disclosed shoe, according to an exemplary embodiment of the present invention.

Subject matter will now be described more fully hereinafter. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as apparatus and methods of use thereof. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention since the scope of the invention will be best defined by the allowed claims of any resulting patent.

The following detailed description is described with reference to the drawings, wherein like reference numerals are used to refer to like elements throughout. In the following description, for purposes of explanation, specific details may be set forth in order to provide a thorough understanding of the subject innovation. It may be evident, however, that the claimed subject matter may be practiced without these specific details. In other instances, well-known structures and apparatus are shown in block diagram form to facilitate describing the subject innovation. Moreover, the drawings are drawn to be to scale.

Referring to FIG. 1-9 which shows different views of the disclosed shoe 10 that has a unique construction for supporting a foot 100 while practicing yoga to prevent injury. FIG. 1 is a medial view of the left foot of the user wearing shoe 10. Besides yoga, the shoe 10 is useful for a wide range of physical activities and has the unique construction of leaving a ball and heel of a wearer's foot 100 uncovered, while covering at least some of the dorsal instep area of the foot and a limited portion of the plantar surface directly under the tarsal bones at the midfoot area of the wearer's foot.

Figure 11:
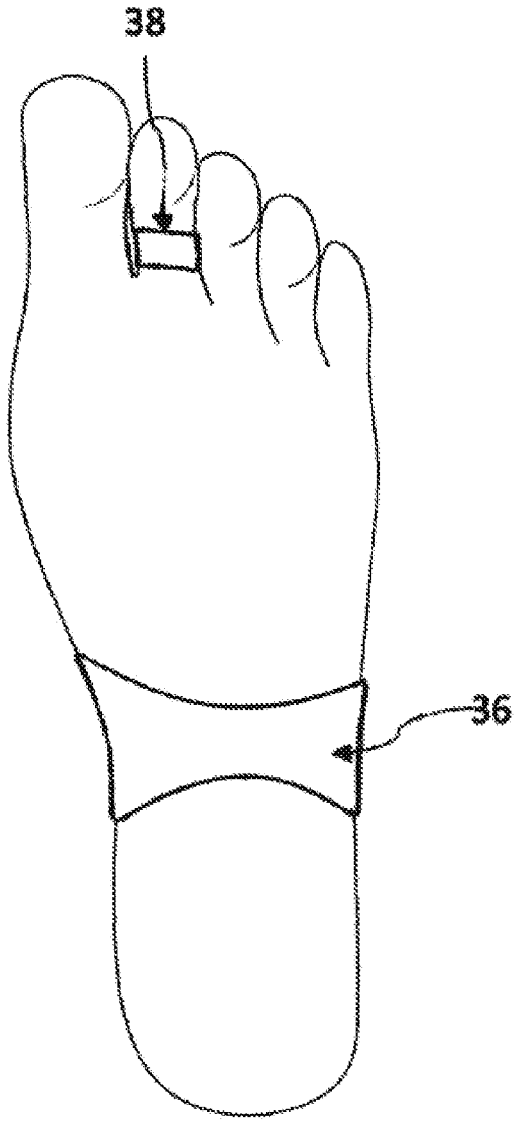
FIG. 11 is the plantar view of the left foot of the user wearing the shoe, according to an exemplary embodiment of the present invention.

For purposes of this application, parts of the wearer's foot include an instep (defined, for purposes of this application, as the dorsum of the foot which faces upwardly when the person is standing, including the area over the dorsal instep area and the metatarsal bones, but excluding the phalanges) and the plantar midfoot (defined, for purposes of this application, the portion of the planum of the wearer's foot located directly under the five tarsal bones of the plantar midfoot area, the area anatomically described for the purpose of this invention as the area directly under the five tarsal bones that make up the midfoot. These five bones are properly named the medial cuneiform bone, the intermediate cuneiform bone, the lateral cuneiform bone, the cuboid bone and the navicular bone. The planum or plantar surface being the portion of the foot that faces downwardly when the person is standing). The ball of the foot is formed generally under the head of the first metatarsal bones of the wearer's foot. The heel refers to the region positioned generally under the calcaneus bone, and the back of the foot is the portion above and behind the heel 1050 and talus 1040 (i.e., the location of the Achilles tendon, shown in FIG. 14). The toes are formed by the phalanges. Since the general construction of the foot is known in the art, this is not discussed in greater detail herein. FIG. 11 shows the anatomy of the feet.

Figure 2:
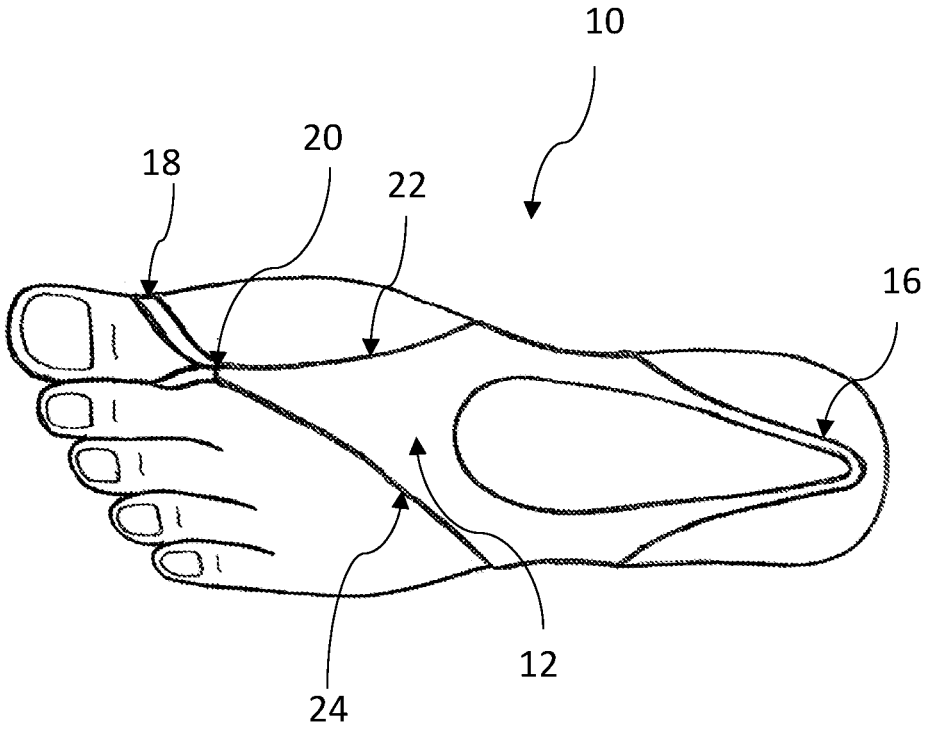
FIG. 2 is a top view of the left foot of the user wearing the shoe, according to an exemplary embodiment of the present invention.

Referring to FIGS. 1-9 which shows different views of the disclosed shoe 10. FIG. 1 is a medial view of the left foot of the user wearing the shoe and FIG. 2 shows a top view thereof. FIGS. 1 and 2 show that shoe 10 has a tubular V-shaped main body 12 connected directly to a toe loop 18 above the foot, and the V-shaped main body 12 connected to the toe loop 18 at an intersection 20. The V-shaped main body of the shoe has a medial edge 22 and a lateral edge 24. An ankle strap 16 extends from the V-shaped main body and wraps around the back of the foot above the heel of the foot but below an ankle bone. The shoe 10 further includes a plantar bridge 14 configured to traverse from side to side across a plantar surface of a midfoot located directly under tarsal bones.

The dorsal aspect of the shoe can be adapted in a V-shape with the smallest point of the V-shaped main body originating at the toe loop intersection/connection 20 and expanding outwardly, with the medial edge 22 of the V-shape main body 12 traversing in a medial direction and the lateral edge 24 of the V-shape main body 12 traversing in a lateral direction over the dorsal instep area of the foot with solid coverage between both edges of the V-shaped main body 12. The V-shape main body provides a solid coverage as it pertains to a V-shaped main body of the invention is described as complete coverage between the medial to the lateral edges of the V-shaped main body as shown in FIG. 2. FIG. 2 clearly shows this intersection of the V-shape main body and the toe loop.

Figure 3:
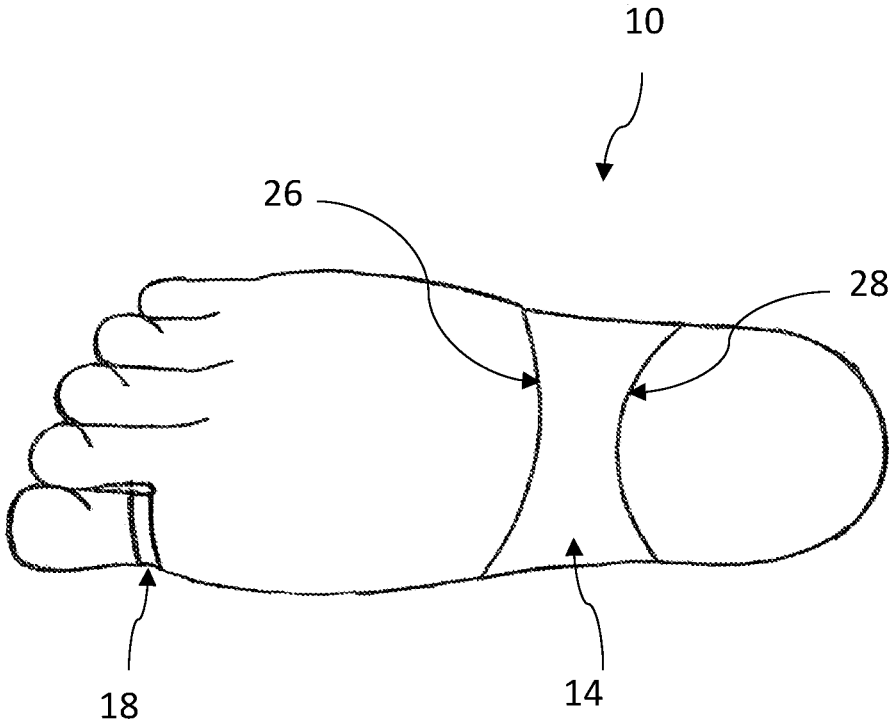
FIG. 3 is a plantar view of the left foot of the user wearing the shoe, according to an exemplary embodiment of the present invention.

FIG. 3 shows a plantar view of the left foot 100 of the user wearing the disclosed shoe 10. As shown in the drawing, the plantar bridge 14 can be adapted into a single one-piece, solid member that is an integral part of the V-shaped main body 12. The plantar bridge has a limited area of coverage located directly under the tarsal bones of the plantar midfoot. FIG. 3 also shows the toe loop 18 with the limited plantar coverage at the base of the big toe encircled by the toe loop 18. This is one of the critical physical features of this shoe to have the plantar surface exposed as shown.

Figure 4:
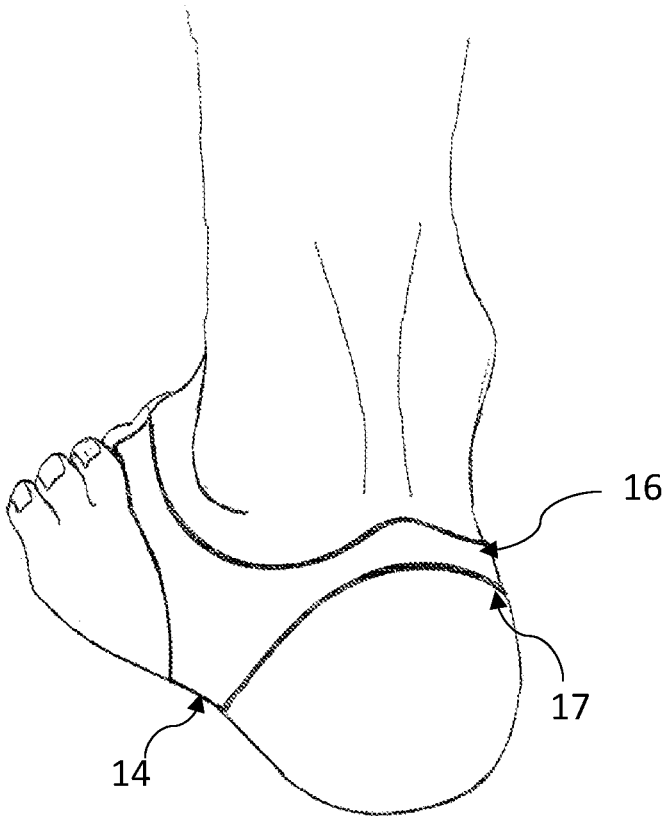
FIG. 4 is a rearward lateral view of the left foot of the user wearing the shoe, according to an exemplary embodiment of the present invention.
Figure 5:
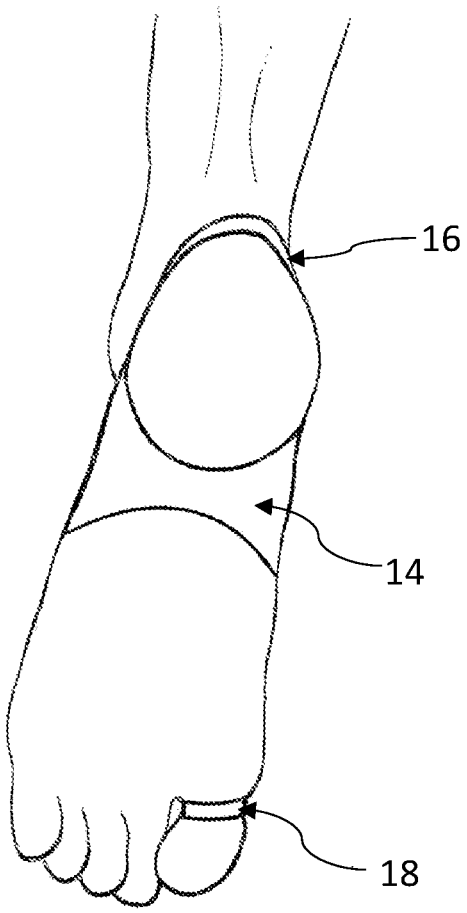
FIG. 5 is a plantar view of the left foot of the user wearing the shoe, according to an exemplary embodiment of the present invention.

FIG. 4 is a rearward lateral view of the disclosed shoe shown worn on the left foot. The lower edge 17 of the ankle strap 16 can be adapted in a curvilinear shape to extend directly from the back of the heel to the medial and lateral undersides of the plantar bridge. FIG. 5 is a plantar view of the left foot of the user wearing the shoe.

Figure 6:
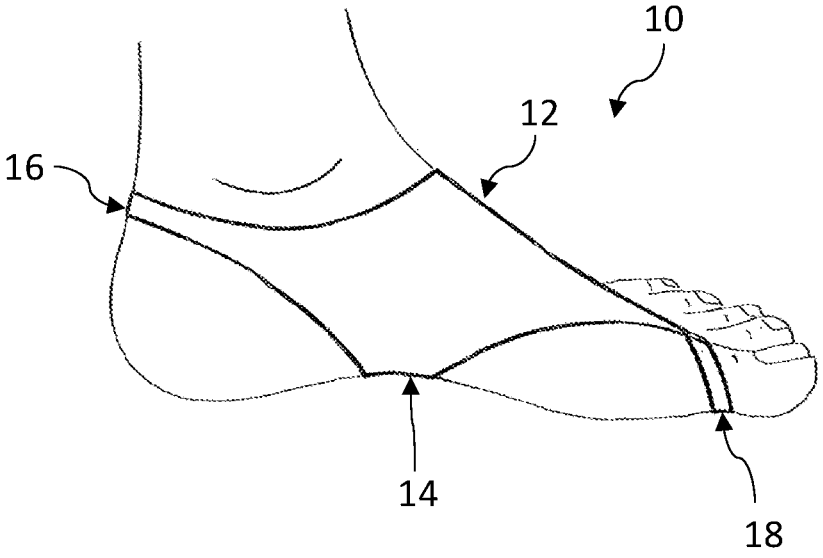
FIG. 6 is a medial view of the left foot of the user wearing the shoe, according to an exemplary embodiment of the present invention.
Figure 7:
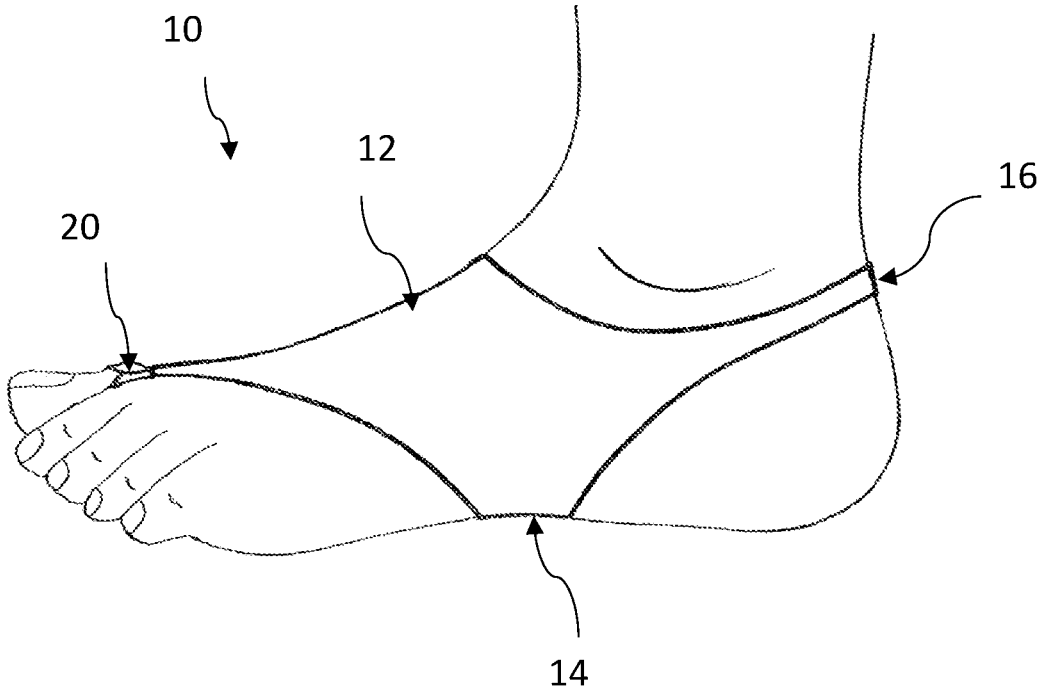
FIG. 7 is a lateral view of the left foot of the user wearing the shoe, according to an exemplary embodiment of the present invention.

Referring to FIG. 6 which shows a medial view of the left foot of the user wearing the disclosed shoe. This drawing shows the V-shape main body 12 and the ankle strap 16 below the medial ankle bone of the user wearing the disclosed shoe. FIG. 7 is a lateral view of the left foot of the user wearing the shoe. FIG. 7 shows the V-shape main body 12 and the ankle strap 16 below the lateral ankle bone of the user wearing the shoe 10.

Figure 8:
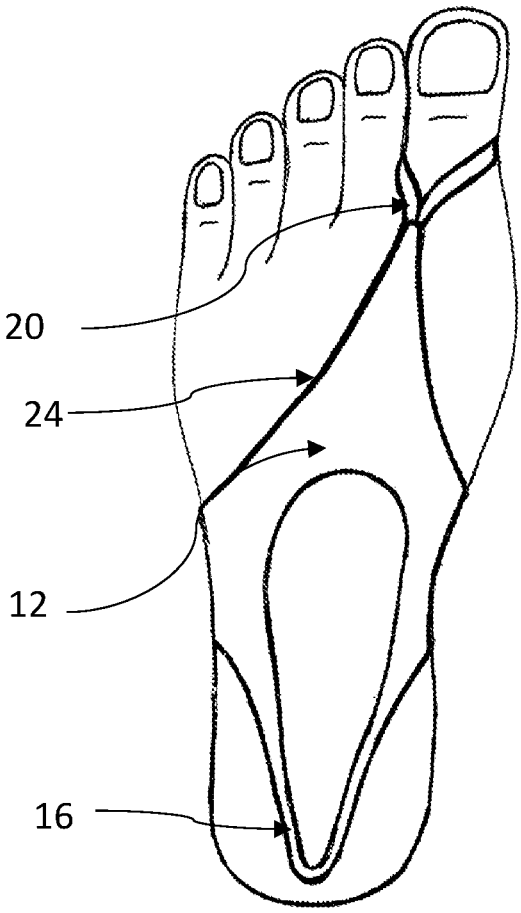
FIG. 8 is a top view of the left foot of the user wearing the shoe, according to an exemplary embodiment of the present invention.
Figure 9:
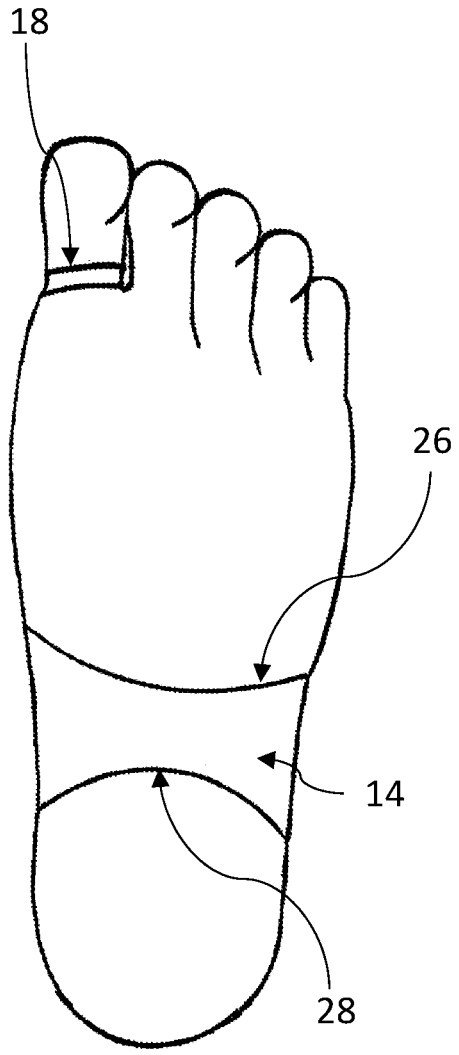
FIG. 9 is a plantar view of the left foot of the user wearing the shoe, according to an exemplary embodiment of the present invention.

FIG. 8 is a top view of the left foot of the user wearing the shoe and FIG. 9 is plantar view thereof. Shoe 10 is more clearly shown in FIG. 8 and FIG. 9. shoe 10 has the V-shaped main body 12, an integral ankle strap 16 that extends from the vertices of the V-shape body 12, a continuous plantar bridge 14, a continuous toe loop 18, and an intersection 20 between the V-shape body 12 and the toe loop 18. The single toe loop of the shoe encircles the big toe of the user from the bottom elevation.

The ankle strap can constrain the shoe from forward movement while the toe loop can constrain the shoe from rearward movement. The plantar bridge, because of its dimension and size can support the flexing of the foot during physical activity, enhancing the movement and preventing potential injury to the foot. The ankle strap, the toe loop, the plantar bridge, and the V-shaped main body can be integral to form a single unit. Such a single unit is economical to manufacture and comfortable to wear.

Figure 10:
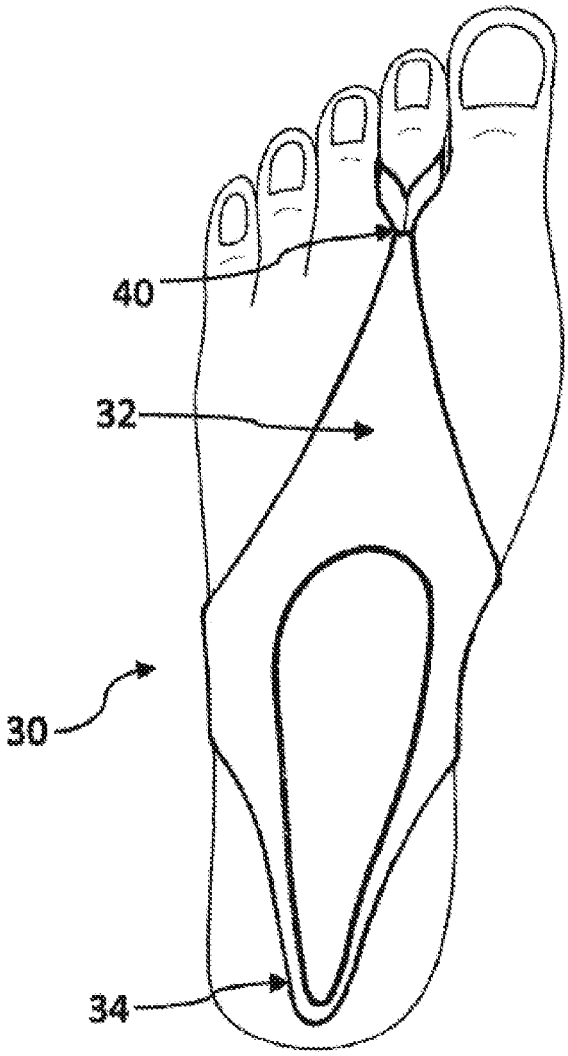
FIG. 10 is a top view of the left foot of a user wearing the shoe, according to an exemplary embodiment of the present invention.

FIG. 9 shows a single toe-loop that wraps around the big toe of the foot. However, the disclosed shoe can also be supported by another toe or more than one toe. For example, FIGS. 10 and 11 show a shoe 30 that has a V-shape main body 32, an ankle strap 34 that extends from the V-shape main body 32, a plantar bridge 36 that is integral with the V-shape main body 32, and a toe loop 38 integral with the V-shape main body 32 at an intersection 40. The toe-loop 38 wraps around the second toe of the left foot.

Figure 12:
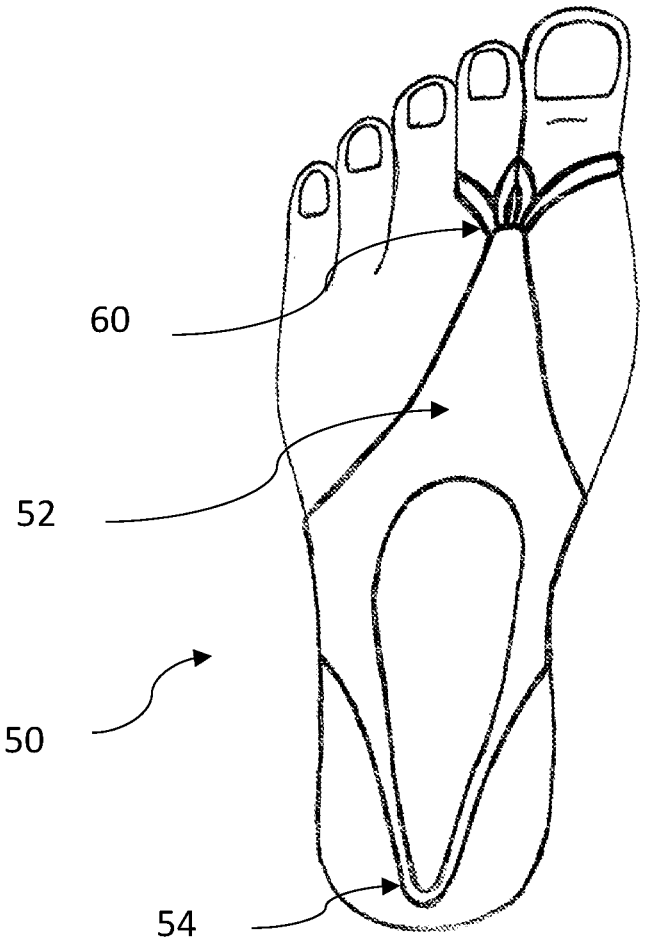
FIG. 12 is a top view of the left foot of a user wearing the shoe constructed, according to an exemplary embodiment of the present invention.
Figure 13:
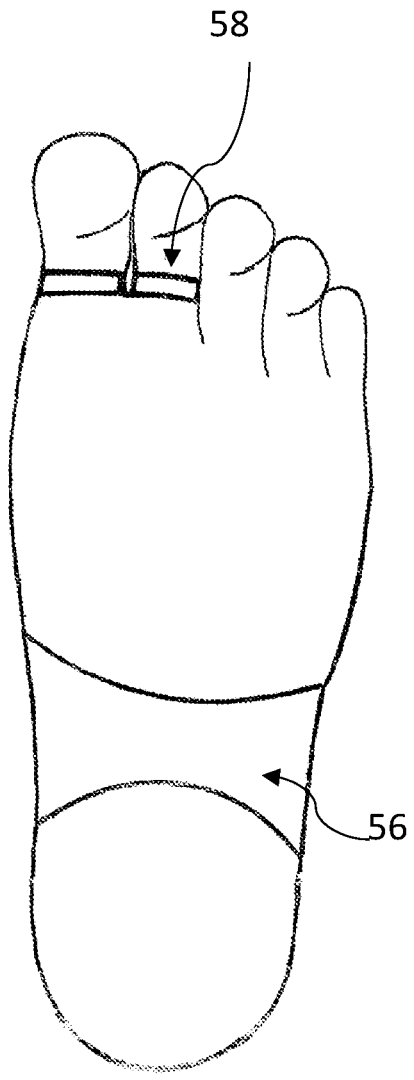
FIG. 13 is a plantar view of the left foot of a user wearing the shoe, according to an exemplary embodiment of the present invention.

Similarly, FIGS. 12 and 13 show another embodiment of a shoe 50 in which the toe loop wraps around two toes i.e., the big toe and the second toe. FIGS. 12 and 13 show the shoe 50 that has a V-shape main body 52, an ankle strap 54 that extends from the V-shape main body 52, a plantar bridge 56 that is integral with the V-shape main body 52, and a toe loop 58 integral with the V-shape main body 52 at an intersection 60.

Figure 14:
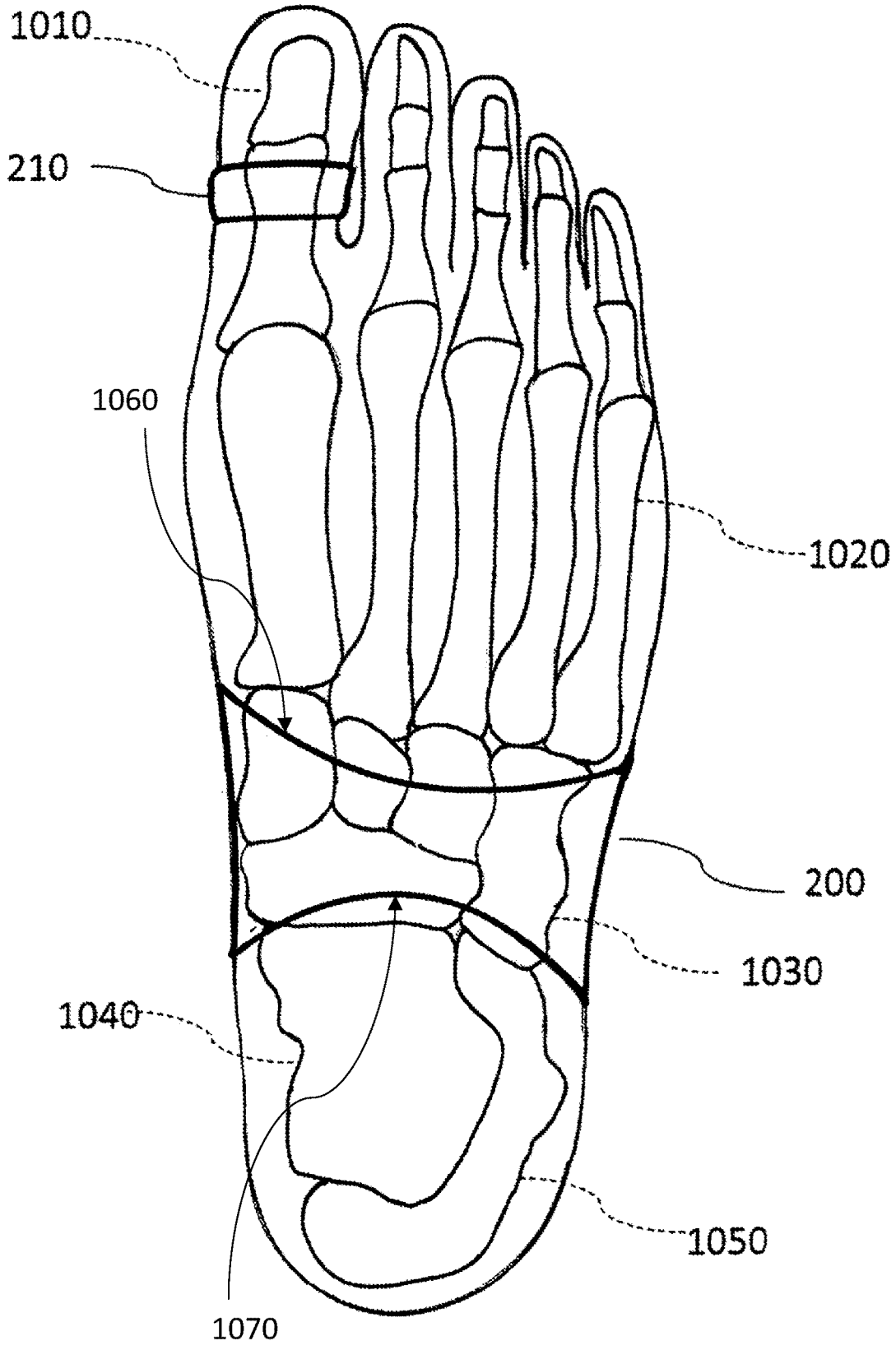
FIG. 14 is a plantar view of a left foot showing all of the anatomical drawings of the bones of the foot and the shoe position relative to the bones, according to an exemplary embodiment of the present invention.

Referring to FIG. 14 which is a schematic diagram showing the anatomy of a foot and the position of the plantar bridge of the disclosed shoe relative to the foot anatomy to further illustrate the critical feature of the invention. The disclosed specialized shoe can support the feet while bending or flexing, such as practicing yoga postures or exercises. The supportive footwear can prevent injury to the foot during flexing and bending. Moreover, this shoe provides the user with the natural grip and sensory perception needed for physically demanding activities such as yoga where balance and movement are of great importance.

As shown in FIG. 14, the majority of the plantar surface of the foot can remain exposed and uncovered except for the small area of the midfoot located directly under the tarsal bones 1030 of the foot. All the plantar surface on the bottom of the foot is uncovered and unrestricted for a natural grip and a nearly barefoot sensory perception of the ground surface, for proper movement and placement of the foot. A single solid strip that traverses from side to side across the plantar surface of the midfoot located directly under the tarsal bones is referred to herein as "the plantar bridge" and provides the desired support to the foot during flexing or bending. It is clear from the drawing that the plantar bridge of the main body does not cover the whole or the whole of the arch area, but a very limited area directly under the five tarsal bones that make up the midfoot and is critical for proper flexing of the foot while performing yoga. The forward edge 1060 and the backward edge 1070 of the plantar bridge on the main body extends from side to side across the plantar surface of the foot located directly under the tarsal bones of the midfoot and extends directly to the toe loop in a curvilinear path with no interruptions or other intersections or connections except the connection/intersection of the toe loop 20.

In one implementation, the ankle strap can be below the ankle bone to provide maximum freedom and movement as well as allow the main body and all its parts to remain in the closest and most snug contact with the foot during a wide variety of movements associated with the practice of yoga. The ankle strap can also be an integral part of the main body and is adapted to extend around the back of the foot above the heel for constraining the main body from forwarding movement, and wherein the ankle strap and the main body are adapted so that they are below the medial and lateral ankle bone of the wearer, that being described anatomically as malleolus of the tibia and the fibula in such a manner that the ankle bone is uncovered and unrestricted and wherein the lower edge of the ankle strap/main body is adapted in a curvilinear shape to extend directly from the back of the heel to the medial and lateral undersides of the midfoot area of the foot crossing the plantar surface directly under the tarsal bones as one solid member.

In one implementation, a toe loop 210 that is adapted to fit around the big toe 1010 or the second toe at the MTP joint (anatomically described as the base of the proximal phalanx which is the most proximal portion of the proximal phalanx bone which articulates via a synovial joint with the adjacent metatarsal to form the metatarsophalangeal joints 1020) leaving the pad (the "pad' of the toe can be anatomically described as the plantar surface contact area of the toe) of the toe exposed without covering any of the other toes.

In another implementation, a single toe loop is disclosed that is adapted to fit around the big toe or the second toe at the MTP joint leaving the pad of the toe exposed without covering any of the other toes.

In another implementation, disclosed footwear can include two toe loops adapted to fit around a big toe and a second toe adjacent to the big toe at the MTP joint leaving the pad of the toe exposed without covering any of the other toes.

In one implementation, the tubular V-shaped main body, the ankle strap, the plantar bridge of the main body, and the toe loop is integral forming a single unit. The V-shaped main body covers a majority of the dorsal instep surface area of the foot. Alternatively, the plantar bridge of the main body can be anchored directly to the toe loop with a curvilinear line to the front of the footwear and anchored directly to the heel of the foot with a curvilinear line, and anchor directly to the solid V-shape tubular main body. In other words, the toe loop, ankle strap, and the V-shaped main body are all anchored to the plantar bridge part or section of the main body and all these parts are tied directly to each other. The distal edge of the plantar bridge extends directly to the toe loop or loops in a curvilinear path to constrain the main body from rearward movement and the rearward edge of the plantar bridge traverses directly to the area above the heel to constrain the main body from forwarding movement.

In one implementation, disclosed is a shoe that is adapted with a single one-piece plantar bridge member that is an integral part of the tubular V-shape main body. The plantar bridge wraps under the midfoot directly under the tarsal bones of the foot with a forward edge 26 and a rearward edge 28 (shown in FIG. 3) with solid coverage between the two edges on the plantar area directly below the five tarsal bones as shown in FIG. 3. The forward edge traverses laterally across the plantar surface of the foot at the midfoot area to the medial and lateral sides of the foot wherein this forward edge then traverses distally in curvilinear path forming a V-shape pattern across the dorsal instep area of foot to the toe loop connection, with the tip of the "V" connecting with the toe loop. The rearward edge of the plantar bridge traverses laterally across the plantar surface of the foot at the midfoot area to the medial and lateral sides of the foot wherein this rearward edge then traverses in a curvilinear path forming the bottom edge of the ankle strap as it traverses to the back of the foot above the heel area.

In one implementation, as shown in FIGS. 1, 6, 7, the shoe 10 includes a main body 12 that wraps around the dorsal instep area of the foot and the plantar midfoot located directly under the tarsal bones of the foot, without covering the ball of the foot, the plantar metatarsals, or the heel or the toes. In this embodiment, the main body is in the form of a tubular V-shaped sleeve having a forward edge 13 and a trailing edge 15 that are separated by a width great enough to cover a majority of the instep and the plantar midfoot area of the foot. For the purposes of this application, the term majority shall be defined to mean over 50%.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A footwear comprising:

a main body having a V-shaped instep portion and a plantar bridge portion; the V-shaped instep portion having a medial edge and a lateral edge, wherein the V-shaped instep portion extends continuously from the medial edge to the lateral edge and is configured to cover a majority of instep of a foot; the plantar bridge portion configured to wrap under the foot from a medial to a lateral side of the foot, and the plantar bridge portion is configured to cover only a midfoot area directly under five tarsal bones of the foot;

a toe loop, wherein the toe loop is configured to encircle a toe around a base of the encircled toe leaving a pad of the encircled toe exposed without covering any of the other toes, and wherein a vertex of the V-shaped instep portion extends from the toe loop; and an ankle strap, wherein the ankle strap extends from the main body and is configured to wrap around a back of the foot above a heel of the foot; the ankle strap and V-shaped instep portion form a continuous, curvilinear top edge, wherein the top edge is configured to extend below a medial and a lateral ankle bone of the foot.

2. The footwear of claim 1, wherein the toe loop is configured to encircle around a big toe of the foot, and the footwear further comprises a second toe loop configured to encircle a second toe of the foot that is adjacent to the big toe.

3. The footwear according to claim 1, wherein the V-shaped instep portion, the plantar bridge portion, and the ankle strap are integrally formed of a single material.

4. The footwear according to claim 1, wherein the toe loop is configured to fit around the big toe or the second toe at the MTP joint leaving the pad of the encircled toe exposed without covering any of the other toes.

* * * * *